US007966734B2

(12) United States Patent
Crain et al.

(10) Patent No.: US 7,966,734 B2
(45) Date of Patent: Jun. 28, 2011

(54) TACK STRIP CUTTER

(75) Inventors: Lance D. Crain, Fremont, CA (US); Michael P. Murphy, Morgan Hill, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 603 days.

(21) Appl. No.: 11/781,876

(22) Filed: Jul. 23, 2007

(65) Prior Publication Data

US 2007/0289143 A1 Dec. 20, 2007

Related U.S. Application Data

(63) Continuation-in-part of application No. 10/902,191, filed on Jul. 28, 2004, now abandoned.

(51) Int. Cl.
*B26B 17/02* (2006.01)

(52) U.S. Cl. ..... 30/254; 30/188; 30/192; 30/251

(58) Field of Classification Search ..... 30/123, 30/261, 251, 131, 134, 135, 181, 184, 196, 30/239, 234, 237, 244, 250, 254, 186, 188, 30/190–194; 7/103, 127–131; 81/427, 427.5
See application file for complete search history.

(56) References Cited

U.S. PATENT DOCUMENTS

| | | | | |
|---|---|---|---|---|
| 2,190,911 | A | 2/1940 | Nebel | |
| 2,207,223 | A | 7/1940 | McGary | |
| 2,449,561 | A | 9/1948 | McGary et al. | |
| 3,790,976 | A | 2/1974 | Stencil | |
| 4,980,975 | A | 1/1991 | Hodson | |
| 5,081,769 | A | 1/1992 | Juros | |
| 5,625,952 | A | 5/1997 | Thomas | |
| 5,987,755 | A | 11/1999 | Shih | |
| 6,260,279 | B1 | 7/2001 | Apolinski et al. | |
| 6,308,421 | B1 | 10/2001 | Wang | |
| 6,598,300 | B2 | 7/2003 | Huang | |
| 6,625,888 | B2 | 9/2003 | Heck et al. | |
| 6,772,520 | B1 | 8/2004 | Shih | |
| 2003/0019045 | A1 * | 1/2003 | Ping | 7/128 |
| 2003/0136008 | A1 * | 7/2003 | Lin | 30/250 |
| 2005/0050735 | A1 | 3/2005 | Huang | |

* cited by examiner

*Primary Examiner* — Phong H Nguyen
(74) *Attorney, Agent, or Firm* — Schneck & Schneck; David M. Schneck

(57) ABSTRACT

A tack strip cutter including a top blade holder and a bottom blade holder having a leverage handle for bringing the blade holders together with a leverage force. A splay inhibition guide on one of the blade holders prevents lateral movement of the blade holders when the tool is used.

13 Claims, 5 Drawing Sheets

TACK STRIP CUTTER

CROSS-REFERENCE TO RELATED APPLICATION

This application is a continuation-in-part of U.S. patent application Ser. No. 10/902,191, filed Jul. 28, 2004.

TECHNICAL FIELD

The present invention relates to hand held cutter devices.

BACKGROUND ART

When installing carpet into a room a tack strip is used to secure the edges of the carpet along the walls. When installing carpet, one edge of the carpet is secured onto the tack strip which extends along the bottom edge of one wall of the room. The carpet is then stretched by stretchers and secured onto the tack strip which has been positioned along the floor next to the walls on the opposite side of the room. The process of installing carpet is similar to stretching the drum skin over a drum. The stretched carpet is held in the final position by the tack strip which extends along the perimeter of the room.

The tack strip is made from strips of plywood, typically 4 or 5 ply plywood, which are at least a ¼ inch thick. A number of tacks are inserted in the plywood in order to hold a carpet backing. Nails are inserted in an opposite orientation from the tacks. The nails then may be nailed into the flooring. The tacks then extend from the tack strip (pointing towards the ceiling) allowing the carpet to be secured to the tack strip. The combination of the tack extruding from the face and the nails holding the strip to the floor is highly effective for holding a carpet in position.

The tack strip may be made in a variety of widths. A variable number of rows of protruding tacks may be used to secure a carpet but at least two rows of protruding tacks is preferred. The tack strip is typically made in a ¾ inch width with tacks in two rows spaced approximately ½ inch apart. The tacks are inserted in an alternating manner, roughly 1 tack every ¾ inch so as to not crack the strip of plywood into the which the tacks are inserted. The tack strip may be made in wider widths such as 1¾ inch in order to allow an extra row of alternating tacks to be inserted in the tack strip. This extra row of tacks is required when the tack strip is used to secure carpet in large rooms. In large rooms the force generated by stretching the carpet into a sufficiently tight position is greater requiring additional tacks to secure the carpet in place.

The tack strip is generally made in lengths of 4 to 5 feet. When laying lengths of tack strip in an area where the carpet is to be installed the carpet installer will often encounter areas where they cannot apply a complete 4 to 5 foot length of tack strip. The installer is required to cut the full length of the tack strip down to a length that will fit in a particular area. This is especially true around doors or irregularly shaped fixtures within a room. Cutting tack strip in a precise manner is very difficult to be done by hand simply by snapping the tack strip. The material is too thick to easily snap by bending and the tacks and nail combination make it difficult to grasp the tack strip. A tool is needed to cut the tack strip to the precise length required.

Although it is possible to cut the tack strip with an axe, this does not allow precision cutting. Precision cutting is needed in corner areas where mitering at a 45° angle is desirable. Use of an axe is also likely to smash down or blunt the sharp tacks of the tack strip. A greater precision is desirable.

A number of tack strip cutters are commercially available. For example, U.S. Pat. No. 3,790,976 to Stencil discloses a device for cutting tack strips including a lower blade holder and an upper blade holder joined at a rear pivot. A handle connects the lower blade holder and upper blade holder. When the handle is depressed the blades held on each holder move together a tack strip to be cut at a precise location.

The tack strip cutter may use replaceable blades. The handle provides a leveraged force providing a downward vertical force which is able to cut through the plywood tack strip. This device also includes a foot at a rear position distal from the two blades on the blade holders. The foot is designed so that it can be positioned on a floor to stabilize the tool during cutting. The handle provides leverage moving the top blade holder towards the bottom blade holder with sufficient force to cut the tack strip across a precise line with relatively little effort. This pressure allows the tack strip to be cut across a precise line using relatively little force.

Such a device may be spring loaded. A spring loaded device is able to open automatically following cutting the tack strip. The razor blades are replaceable and extra blades may be stored in a compartment on the device.

The tool is used a number of times in installation of carpet even in average size homes. As homes are built with increasingly open plans having large rooms, the use of 5-ply or greater tack strips and 1¾ inch wide tack strips are more common. To cut through these wider tack strips requires the use of longer replaceable blades. The blades also must be taller to allow for cutting through material that is increasingly thick. In addition greater leverage forces are needed.

After repeated use, the blades begin to dull, and a number of problems develop. Dull blades resist cutting into the plywood causing one or both blade carriers to deflect longitudinally away from each other. This has a number of effects. First it diminishes the downward force of the blades since some of this force is now going to be channeled to moving the blades to the side. This increases the pressure required to cut through the strip. Secondly, as the blades deflect away from each other a gap between the blades widens. When this gap is sufficiently wide a thin strip of wood is cut by the two blades and may be stuck between the blades after the tack strip has been cut. This thin fragment of wood often becomes wedged between the blades. This prevents the spring-loaded handle from opening automatically because the blades are pinned in place by the wood fragment. The user must jar this fragment from between the blades. This is done by striking the tool on the surface to pry open the jaws. Alternatively, a user could pry out the fragment manually. However, such manual removal of the thin wood fragment from between the blades exposes the user's fingers to possible injury from the blades.

To prevent the fragments from sticking between the blades, the user may decide to frequently change the blades. However blades are costly and changing the blades takes time. An improved cutter that can reduce the deflection of the blades could allow the blade life to be extended, thereby reducing costs. It is an object of the invention to provide a tack strip cutter in which the longitudinal deflection of the blades is minimized.

SUMMARY OF THE INVENTION

The present objects are achieved with a tack strip cutter which includes a top elongate blade holder and a bottom elongate blade holder. The two blade holders are connected at a rear pivot to connect the rear sections of the blade holders and a leverage handle to connect the central portions of the blade holders. The leverage handle connects the top elongate blade holder and bottom elongate blade holder such that pressing the handle moves the blade held by the top blade holder towards the blade held by the bottom blade holder. On one of the top blade holder or bottom blade holder is a splay inhibition guide. The "splay inhibition guide" is defined as a vertical projection of either the top blade holder or bottom blade holder that inhibits splay of the blades by confining the elongate blade holders relative to each other. The splay inhibition guide provides a physical structure that limits the sideways or longitudinal deflection of the blade as the blade moves vertically towards a tack strip to be cut. The splay inhibition guide may have a reciprocal surface or groove on the elongate blade holder that does not contain the splay inhibition guide.

In a tack strip cutter, one of the elongate blade holders (the bottom blade holder in one embodiment) contains a first pivot and the two elongate blade holders are joined at their back ends (the ends opposite the blade holding ends) by a rear pivot. The other elongate blade holder is also separately attached to the leverage handle. The splay inhibition guide is preferably mounted proximate to the attachment locations of the handle to the elongate blade holders. In this instance "proximate" may be defined as "as close to the attachment location of the first and second elongate blade holders to the handle as is practical to manufacture.

The "splay inhibition guide" is further defined as closer to the front pivot than the rear pivot and not extending beyond the location of the midpoint between the front the rear pivot. The splay forces generated are generated at the location of the blades. The design of the tool requires that splay inhibition guide be placed between the handle attachments and the rear pivot. If a guide used to prevent splay were located proximate to the rear pivot, it would be farthest from the forces that cause splay and ineffective. If a guide used to prevent splay ran for more than half the length between the handle and the rear guide, the manufacturing of this device would be cumbersome. The present splay inhibition guide, as presently defined, is allows splay inhibition with minimal changes to a tack strip cutter.

Additional elements may be added to the tool. The handle may be spring-loaded to allow automatic raising of the handle and opening of the jaws following each use. The handle may also include a lock to lock the handle in a down position. The handle may also include a stop to prevent the handles from being pressed too far down towards the elongate blade holders. The tool may also include a foot extending from the back of the bottom elongate blade holder. This foot would allow the tool to rest stably upon the ground (or another surface) during a cutting procedure. The handle of the tool may also include a storage area for holding additional blades. The tool may be made of forged steel or other suitable material.

DETAILED DESCRIPTION OF THE INVENTION

Figure 1:
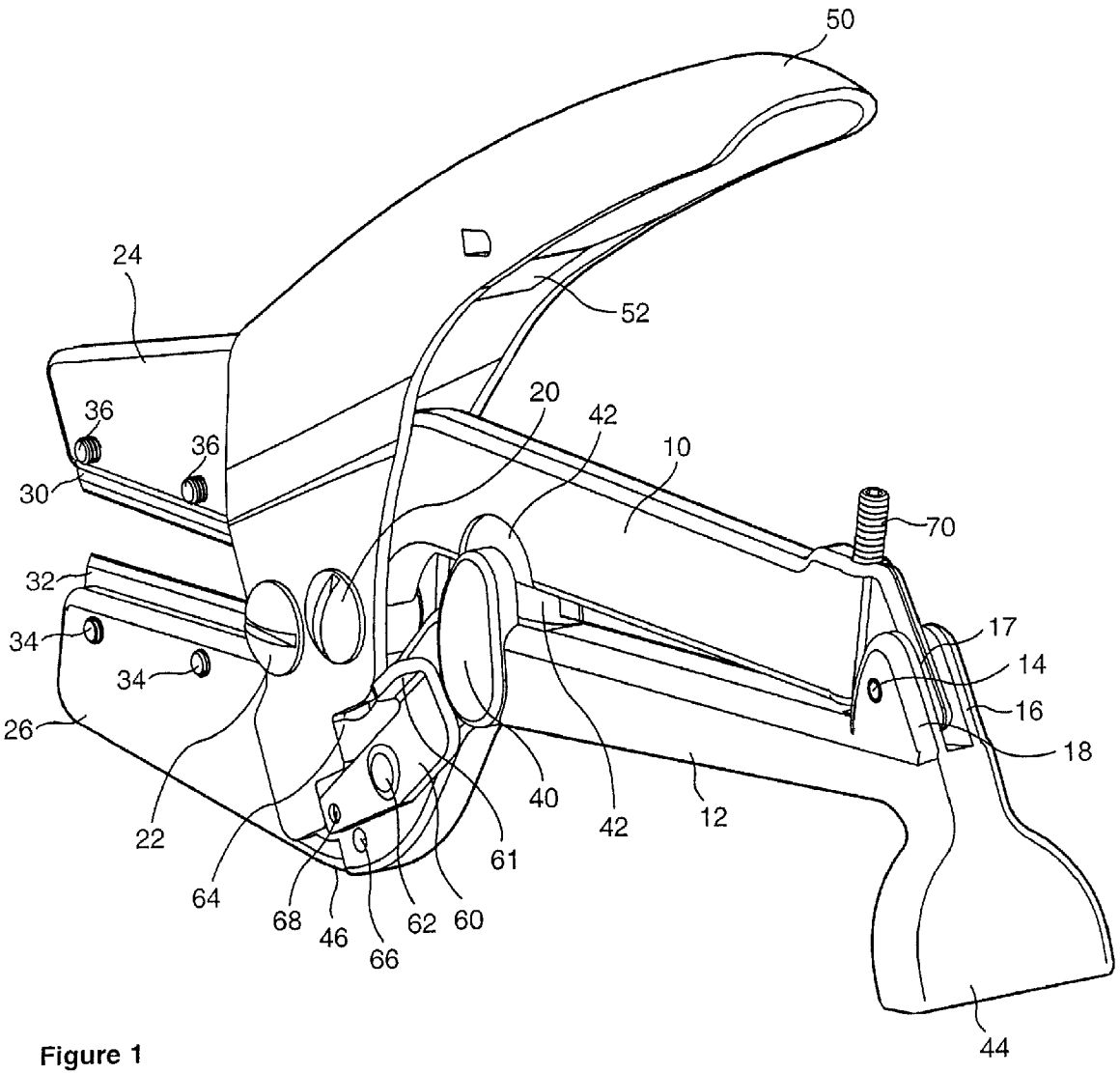
FIG. 1 is a side perspective view of one embodiment of the tack strip cutter.

The invention will be understood with relation to the following figures. With reference to FIG. 1, top elongate blade holder 10 and bottom elongate blade holder 12 are connected at rear pivot connection 14. A pair of brackets 16, 18 on the bottom elongate blade holder allow a fin 17 to be held at pivot connection 14. This secures the rear portions of top elongate blade holder 10 and bottom elongate blade holder 12 together in a pivotable fashion.

At the front portion of top elongate blade holder 10 is an upper jaw 24. Blade 30 is held on upper jaw 24 by bolts 36. Similarly at the front of bottom elongate blade holder 12 is a lower jaw 26. A blade 32 is held by bolts 34 on lower jaw 26.

Handle 50 connects top elongate blade holder 10 to bottom elongate blade holder 12 near the mid section of each blade holder just behind upper jaw 24 and lower jaw 26. Handle bolt 22 extends through bottom elongate blade holder 12 and bolt 20 extends through top elongate blade holder 10. Bolts 20, 22 also extend through each side of the handle 50. When handle 50 is depressed downwards top elongate blade holder 10 is moved towards bottom elongate blade holder 12. The rear of the top blade holder 10 pivots on pivot 14 allowing the blades 30, 32 to close together. It is preferred that the blades close together such that the blade tips pass to the side of each other. Direct contact of the edges of the blades would dull the blades and be less effective in cutting through the tack strip. The blades are able to pass by the sides of each other cutting entirely through the tack strip.

The handle 50 has two side arms which fit against either side of the top elongate blade holder and bottom elongate blade holder 10, 12. The metal of the handle is much thinner than the metal of the elongate blade holders and allows a certain amount of longitudinal movement during cutting. The addition of splay inhibition guide 40 on the bottom blade holder 12 allows a greatly reduced amount of longitudinal movement of the top elongate blade holder 10 with respect to bottom elongate blade holder 12. The top elongate blade holder 10 is shown as having a splay inhibition guide groove 42 which allows a relatively tight fit into splay inhibition guide 40. When the handle 50 is raised and the upper jaw 24 and lower jaw 26 are maximumly spread apart the splay inhibition guide 40 is sufficiently tall such that the top elongate blade holder 10 is contained between the width defined by splay inhibition guide 40. This ensures precision alignment.

Handle 50 may also include a lock 60. Lock 60 includes a finger tab 61 for positioning the lock. When handle 50 is depressed lock 60 may be pivoted on pivot mount 62 such that the forward portion of lock 60 is positioned against surface 64 on handle 50. This would lock the blade in a down position with jaws 24, 26 together. This is the safest way to store the tool and minimize the risk of the blade damaging other tools or injuring a user. A tooth 68 on the front of lock 60 may be secured into an indentation 66 on bottom elongate blade holder 12. This prevents the lock 60 from inadvertently locking during normal use.

Bottom elongate blade holder 12 has a foot 44 at the back end of the tool and a surface 46 at the base of the jaw. Foot 44 allows the tool to be rested on a flat surface during cutting. The user may then use body weight to provide the force onto the handle for cutting through tack strips.

At a rear section of the tool is stop 70. This provides a limit to the movement of the handle restricting the amount to which the handle can move towards bottom elongate blade holder 12. Thus when the blades are fully closed towards each other stop 70 limits the gap overlap of the blades to a selected amount.

As shown in FIG. 1, blade 30 is held in jaw 24 of top elongate blade holder 10 in a cutting position by screws 36, and blade 32 is held in jaw 26 of lower elongate blade holder 10 by screws 34. With reference to a tack strip cutter, the locations of blade 30 and 32 are cutting positions, in the sense that in operation they will contact the tack strip being cut. When leverage handle 50 is depressed, top blade 30 will contact the tack strip and press it onto bottom blade 32, and both blades are in a position to cut the tack strip. Blade storage clip 52 is located on handle 50, but the blades held by blade storage clip 52 are not in a cutting position. As leverage handle 50 is a separate element from top elongate blade holder 10 and bottom elongate blade holder 12, leverage handle 50 of the tack strip cutter does not hold a blade in a cutting position.

As shown in FIG. 1, a tack strip cutter has a handle 50 which will be further defined as the leverage handle. A leverage handle is the position where the user should place a hand to exert downward effort in order to activate the tool.

As defined herein, a compound leverage device is a device having one lever which activates a second lever. As further defined herein, a compound leverage tack strip cutter is a tack strip having one lever which activates a second lever.

In one embodiment of a compound leverage tack strip cutter, as shown in FIG. 1, a compound leverage tack strip cutter has a first lever formed by a first top elongate blade holder 10, a second bottom elongate blade holder 12, and a first pivot 14. The first pivot 14 is a pivoting connection between the first top elongate blade holder 10 and the second bottom elongate blade holder 12, and is formed by a pin 15 as will be discussed with reference to FIG. 2. A second lever is formed by leverage handle 50, bottom elongate blade holder 12, and a second pivot formed by the handle bolt 22. Bolt 20 extends through leverage handle 50 and top elongate blade holder 10. When leverage handle 50 is activated and pivots downwardly on the second pivot formed by handle bolt 22, bolt 20 exerts downward effort on first top elongate blade holder 10. The first lever formed by top elongate blade holder 10, bottom elongate blade holder 12 and first pivot connection 14 is activated by the second lever formed by leverage handle 50, bottom elongate blade holder 12 and the pivot formed by handle bolt 22. Bolt 20 links the second lever to the first lever and transfers force from the second lever to the first lever. For this reason, bolt 20 will be further defined and referred to herein as an example of a force transfer linkage. The force transfer linkage causes one lever to activate another lever in the compound leverage device. Thus, the compound leverage tack strip cutter of FIG. 1 meets the definition of a compound leverage device.

A compound leverage tack strip cutter has additional elements which make it distinct from scissors or pruning shears. Scissors or pruning shears are simple leverage devices having only a single pivot. Scissors or pruning shears normally do have two levers formed by each of two handles or finger loops, but these levers share a single central pivot, and act independently. In contrast, a compound leverage tack strip cutter has two pivots which form two levers, plus a separate force transfer linkage, which transfers force from one lever to the other.

Figure 2:
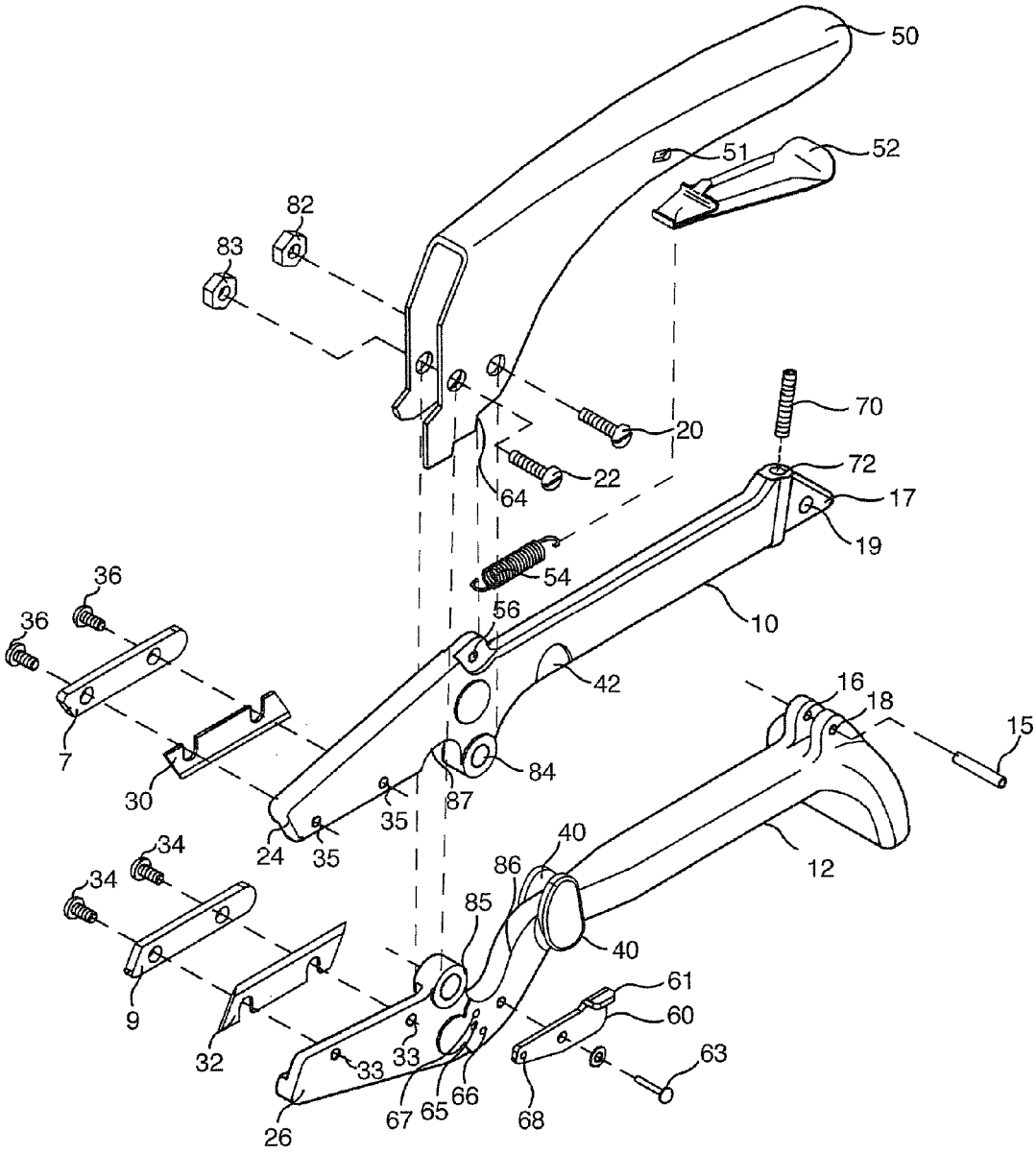
FIG. 2 is an exploded view of the tack strip cutter.

With reference to FIG. 2, the exploded view of this device shows how the component parts of the device are assembled. Bottom elongate blade holder 12 at the rear has brackets 16, 18. Fin 17 fits between these brackets such that hole 19 aligns with the holes on brackets 16, 18 and pin 15 may be driven through the hole on bracket 18, hole 19 and the hole on bracket 16 and then secured. The pin 15 may simply be frictionally secured by sizing holes on bracket 16, 18 appropriately such that the pin is frictionally retained in place. This pin then joins the top elongate blade holder 10 to bottom elongate blade holder 12 at a location at the back of each elongate blade holders.

On top elongate blade holder 10 at the front of blade holder 10 on upper jaw 24 a replaceable razor blade 30 is held on by securing bar 7. Threaded bolts 36 extend through securing bar 7 and screw into tapped holes 35 on upper jaw 24 securing the blade in place. A blade 32 is similarly secured to bottom elongate blade holder 12 by securing bar 9. Bolts 34 extend through holes on securing bar 9 through notches on blade 32 and into tapped holes 33 on lower jaw 26. When the tool is assembled the blades face in opposing orientations. When the upper jaw 24 and lower jaw 26 are closed together the blades pass side-by-side with minimal gap between the sharpened points of the blades. This allows the blades to cut through a plywood strip without resulting in non-advantageous slivers of wood being caught between the blades.

Spring-loaded handle 50 is attached just behind the upper jaw 24 and lower jaw 26 joining the middle sections of top elongate blade holder 10 and bottom elongate blade holder 12 together. Bolt 20 extends through a hole on one side of handle 50 through hole 84 on top elongate blade holder 10 through a hole on the other side of handle 50 where it is secured by nut 82. In a similar manner, handle bolt 22 extends through one side of handle 50 through hole 85 on bottom elongate blade holder 12 through a hole on the opposite side of handle 50 where it is secured by nut 83.

Spring 54 is attached at one end by securing a spring hook through hole 56 on top elongate blade holder 10. Spring 54 is attached at the opposite end to a tab on pivoting blade retainer 52. Pivoting blade retainer 52 is held by clipping onto hook 51 on handle 50. Spring 54 provides a force holding the elongate blade holders such that upper jaw 24 and lower jaw 26 are held apart and the handle is held up until a force is applied to the handle. Spring 54 also holds pivoting blade retainer 52 such that it is held against the underside of handle 50. By pressing the end of pivoting blade retainer 52, the retainer may pivot downward. This provides access to a small space between pivoting blade retainer 52 and handle 50. A number of spare blades (not shown) may be stored in this space.

At the back of top elongate blade holder 10 a handle stop 70, which may be a threaded pin, is inserted into threaded receiving hole 72. By screwing down pin 70 to a selected level the level at which handle 50 may be depressed may be selected. Pin 70 acts as a stop restricting the amount handle 50 may be depressed. This may be used as a method to limit the motion range of the blades held in the holder.

Lock 60 is held by pin 63 on bottom elongate blade holder 12. Finger tab 61 allows movement of this lock. A tooth 68 on the front of lock 60 may be positioned in one of indentations 65, 66, and 67. When positioned in indentation 67 with handle 50 depressed, handle 50 is held in a locked-down position. If lock 60 is positioned in either of indentations 65 or 66, handle 50 may be raised or lowered.

A splay inhibition guide 40 extends from opposite sides of bottom elongate blade holder 12. The splay inhibition guide 40 is a symmetrical protrusion in the bottom elongate blade holder 12. In one embodiment, the splay inhibition guide 40 is approximately 0.625 inches thick. The base thickness of the part is approximately 0.55 inches for comparison. Since the splay inhibition guide 40 in this embodiment is symmetrical with the center line of the bottom elongate blade holder 12, the splay inhibition guide 40 protrudes from both sides of the bottom blade holder 12 approximately 0.0375 inches.

In normal use, when the handle is in a down position the top elongate blade holder 10 and bottom elongate blade holder 12 nearly touch at the location of the splay inhibition guide 40. This makes this location of the splay inhibition guide 40 preferred for the location of controlling the deflection of the blade holders in relation to each other. The thickness of the top elongate blade holder 10 is approximately 0.275 inches. The width of the slot in the splay inhibition guide 40 must be slightly larger than this dimension to allow the top elongate blade holder 10 to travel within the slot without excessive rubbing which would require additional force for use of the tool. To create the exact dimensions of the slot in the splay inhibition guide requires precise machining. Splay inhibition guide 40 may be machined with a 0.250 inch milling cutter creating a precision slot having a width of 0.250 inches. Either or both sides of the top elongate blade holder 10 which fit into the splay inhibition guide 40 may be machined to create a precision thickness in this area. However, for efficiency it is preferable to machine only one face. The thickness of the top elongate blade holder 10 at the location where it fits into splay inhibition guide 40 after machining to a precision width is 0.242 inches. After machining, the parts may be plated which tends to slightly decrease the slot in the splay inhibition guide 40 area and increase the thickness of the precisely machined surface 42 of blade holder 10. A fit of approximately 0.008 inches between the slot and the splay inhibition guide 40 is an effective practical tolerance and is more than adequate to control deflection of the blades.

When the tool is assembled, the top elongate blade holder 10 is fully captured within the splay inhibition guide 40 along its entire range of motion. The razor blades which are mounted on the blade carriers precisely align so that they pass each other to the side and do not directly meet tip-on-tip. This allows cutting the tack strip all the way through and prevents dulling of the blades. If necessary, the elongate blade holders 10, 12 may be bent by hand or machine to achieve final proper blade alignment. The parts may be made of a variety of materials. In one embodiment, the tool is made as drop forgings of solid steel.

Figure 3:
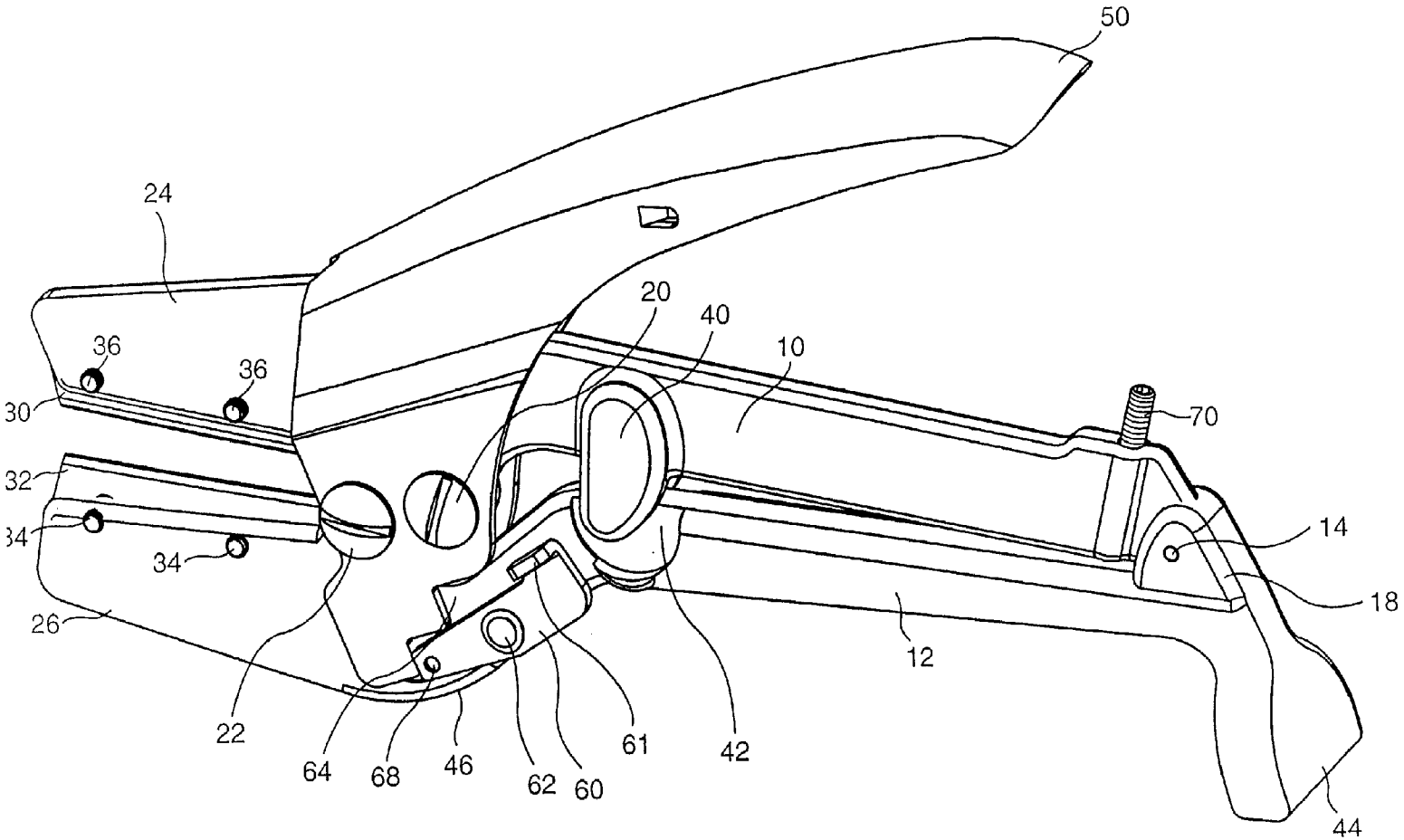
FIG. 3 is a side perspective of an alternative embodiment having the splay inhibition guide on the top blade holder rather than on the bottom blade holder.
Figure 5:
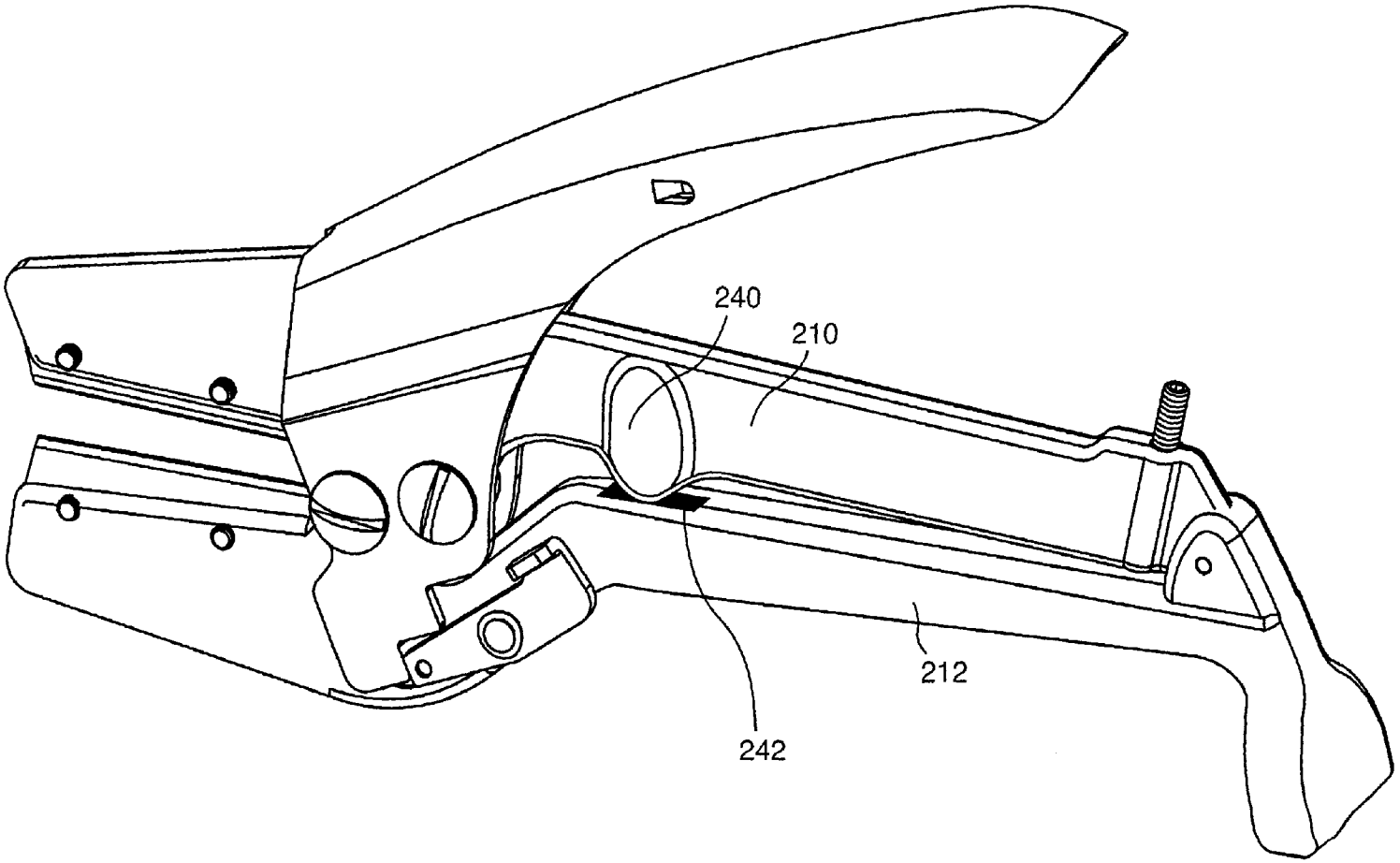
FIG. 5 is a side perspective view of an alternative embodiment of a tack strip cutter.

In one embodiment, splay inhibition guide 40 is a feature of bottom blade holder 12. This embodiment adapts this configuration for added stability. Because bottom blade holder typically rests on a floor surface during cutting, this provides an extremely steady foundation to prevent deflection. However, other configurations of a splay inhibition guide will become readily apparent to those skilled in the art based on the disclosure herein. As shown in FIG. 3, the splay inhibition guide may be formed from a symmetrical protrusion in top blade holder 10. A slot machined in a splay inhibition guide of top blade holder 10 would also control deflection. The inner machined surfaces of the boss would fit precisely over a machined surface (or surfaces) such as surface 42 on the bottom blade holder 12, thereby preventing longitudinal deflection of the blades. As shown in FIG. 5, a splay inhibition guide may also be a thin, downward projection such as projection 240 in the bottom of the top blade holder 210, along with cooperative hole 242 of similar shape to the projection on the lower blade holder 212. Such a design which includes a projection and a hole may have the projection on either the top or bottom blade holder, with a corresponding hole of similar shape in the opposite blade holder for receiving the projection.

Figure 4:
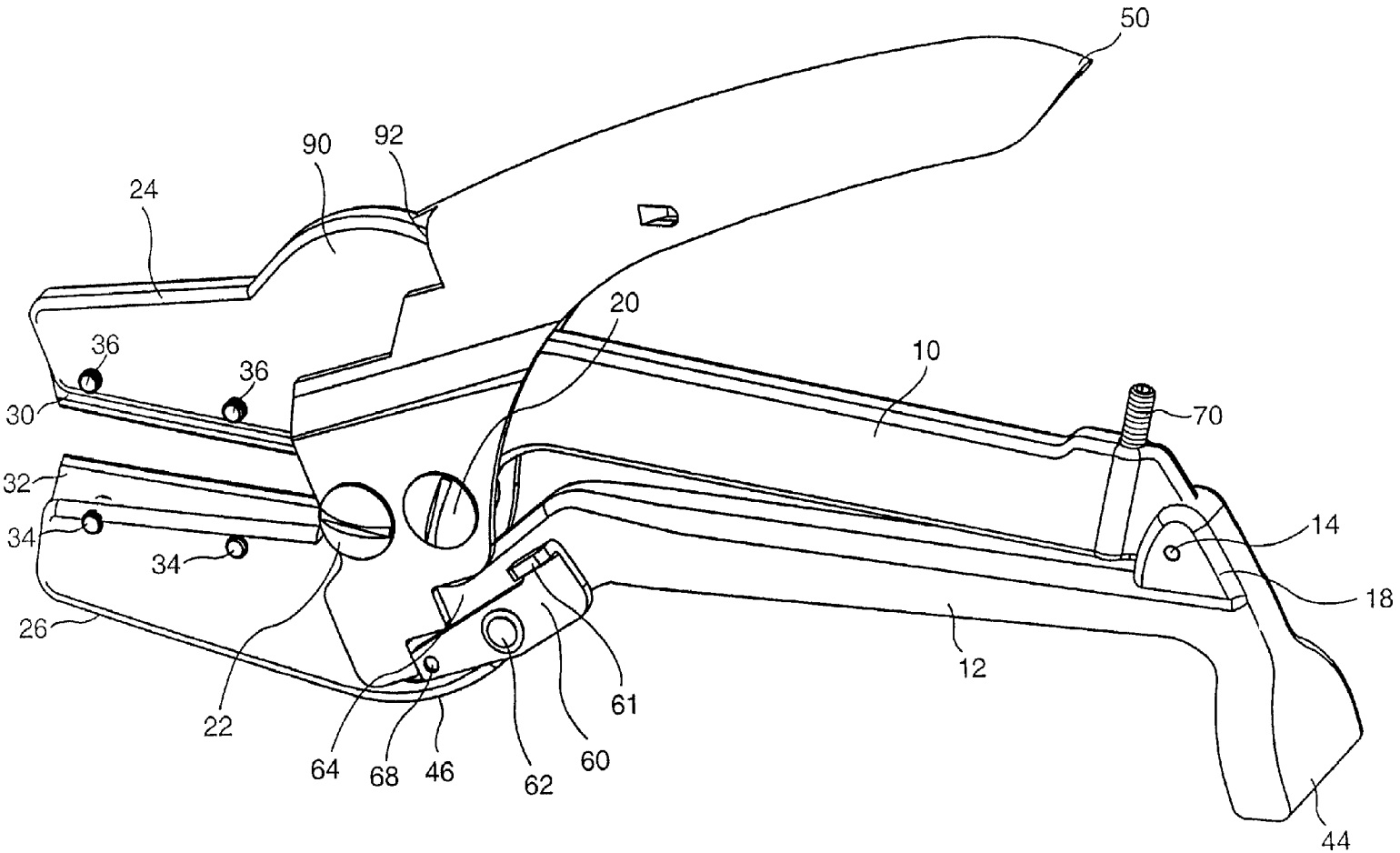
FIG. 4 is a side perspective view showing how the top blade holder may have a splay inhibition guide that works with the leverage handle to reduce longitudinal deflection of the blades.

Furthermore, as shown in FIG. 4, a splay inhibition boss may also be created by placing a boss 90 on the top edge of top blade holder 10 where it nearly touches handle 50. Such a boss could extend into a slot 92 on handle 50, thereby preventing the longitudinal deflection of top blade holder 10. Controlling the longitudinal motion of bottom blade holder 12 is not nearly as critical, because it typically rests on a floor surface and is thereby prevented from much horizontal deflection. However, as previously mentioned, handle 50 is typically made from a thin material, and is not nearly as suitable to control longitudinal deflection as bottom blade holder 12, or top blade holder 10.

What is claimed is:

1. A compound leverage tack strip cutter, comprising:

a top elongate blade holder with an upper jaw configured to secure a first blade;

a bottom elongate blade holder movably connected to the top elongate blade holder at a first pivot and with a lower jaw configured to secure a second blade, the first pivot allowing the upper jaw and the lower jaw to move towards each other;

a leverage handle movably connected at a second pivot to the bottom elongate blade holder;

the leverage handle being further movably connected to the top elongate blade holder by a fastener passing through at least a fastener aperture in the leverage handle and a fastener aperture in the top elongate blade holder;

a splay inhibition guide included with one of the top elongate blade holder or the bottom elongate blade holder; and a guide surface included with the other of the top elongate blade holder or the bottom elongate blade holder; wherein displacing a terminal end of the leverage handle downward towards the first pivot displaces the upper jaw downward towards the lower jaw;

the splay inhibition guide is at least a first and a second protrusion from one of the top elongate blade holder or the bottom elongate blade holder; and the splay inhibition guide cooperates with the guide surface to restrict misalignment of the upper jaw and the lower jaw.

2. The compound leverage tack strip cutter of claim 1 further comprising a foot attached to the bottom elongate blade holder proximate to the first pivot.

3. The compound leverage tack strip cutter of claim 1 wherein the splay inhibition guide, the guide surface and the first pivot are configured to align the first blade secured in the upper jaw and the second blade secured in the lower jaw.

4. The compound leverage tack strip cutter of claim 1 wherein the splay inhibition guide is at least a protrusion from one of the top elongate blade holder or the bottom elongate blade holder, cooperating with a guide aperture in the other of the top elongate blade holder or the bottom elongate blade holder.

5. A compound leverage tack strip cutter, comprising:

a top elongate blade holder having a top elongate blade holder pivoting end and having an opposing top elongate blade holder cutting end configured to hold a blade in a cutting position at an upper jaw;

a bottom elongate blade holder having a bottom elongate blade holder pivoting end and having an opposing bottom elongate blade holder cutting end configured to hold a blade in a cutting position at a lower jaw;

a foot at the bottom elongate blade holder pivoting end, said foot and said lower jaw being dimensioned to stably support the tack strip cutter in a freestanding position on a level surface;

a first pivot connecting said top elongate blade holder pivoting end and said bottom elongate blade holder pivoting end, proximate to the foot;

a leverage handle connected at a second pivot to said bottom elongate blade holder, and connected at a force transfer linkage to said top elongate blade holder, the linkage being between the first and second pivots, such that pressing said leverage handle moves said upper jaw towards said lower jaw;

a splay inhibition guide formed on one of said top elongate blade holder or said bottom elongate blade holder, the guide being proximate to the linkage and being between the linkage and the first pivot; and a surface in or on the other of said top elongate blade holder or said bottom elongate blade holder which may be guided by said splay inhibition guide.

6. The compound leverage tack strip cutter of claim 5, wherein said top elongate blade holder and said bottom elongate blade holder position blades affixed to each holder such that said blades pass side by side for a portion of each blade.

7. The compound leverage tack strip cutter of claim 5, further including a spring connected between said top elongate blade holder and the leverage handle.

8. The compound leverage tack strip cutter of claim 5, wherein said splay inhibition guide is sufficiently tall to constrain sideways displacement of said top elongate blade holder for an entire range of motion of said top elongate blade holder.

9. The compound leverage tack strip cutter of claim 5 wherein the splay inhibition guide is at least a first and a second protrusion from the bottom elongate blade holder.

10. The compound leverage tack strip cutter of claim 5 wherein the splay inhibition guide is at least a first and a second protrusion from the top elongate blade holder.

11. The compound leverage tack strip cutter of claim 5 wherein the splay inhibition guide is at least a downward protrusion from a bottom of the top elongate blade holder, cooperating with an aperture in the bottom elongate blade holder.

12. The compound leverage tack strip cutter of claim 5 wherein the splay inhibition guide is at least an upward protrusion from a top of the bottom elongate blade holder, cooperating with an aperture in the top elongate blade holder.

13. The compound leverage tack strip cutter of claim 5 wherein the surface guided by the splay inhibition guide closely fits the splay inhibition guide to a precision tolerance.

* * * * *